US010189620B1

(12) United States Patent
Small

(10) Patent No.: US 10,189,620 B1
(45) Date of Patent: Jan. 29, 2019

(54) COMBINATION LOCKING PUZZLE GIFT BOX

(71) Applicant: Steven Douglas Small, Novato, CA (US)

(72) Inventor: Steven Douglas Small, Novato, CA (US)

(73) Assignee: Steven Douglas Small, Novato, CA (US)

( * ) Notice: Subject to any disclaimer, the term of this patent is extended or adjusted under 35 U.S.C. 154(b) by 113 days.

(21) Appl. No.: 15/345,254

(22) Filed: Nov. 7, 2016

(51) Int. Cl.

| | |
|---|---|
| ***B65D 43/12*** | (2006.01) |
| ***B65D 55/14*** | (2006.01) |
| ***E05B 37/00*** | (2006.01) |
| ***E05B 37/02*** | (2006.01) |
| ***E05B 65/46*** | (2017.01) |

(52) U.S. Cl.
CPC ..... *B65D 55/145* (2013.01); *B65D 43/12* (2013.01); *E05B 37/0072* (2013.01); *E05B 37/02* (2013.01); *E05B 65/46* (2013.01)

(58) Field of Classification Search
CPC ... B65D 55/145; B65D 43/12; E05B 37/0072; E05B 37/02; E05B 65/46
USPC ..... 206/459.5, 308.1, 308.2
See application file for complete search history.

(56) References Cited

U.S. PATENT DOCUMENTS

| | | | | |
|---|---|---|---|---|
| 3,988,909 | A | 11/1976 | Catapano | |
| 4,227,388 | A | 10/1980 | Nigrelli | |
| 4,573,332 | A | 3/1986 | Ma | |
| 4,690,292 | A | 9/1987 | Henning | |
| 4,869,082 | A | 9/1989 | Appelbaum | |
| 4,991,729 | A | 2/1991 | Hunter | |
| 5,172,575 | A | 12/1992 | Fisher | |
| 5,277,325 | A | 1/1994 | Yan | |
| 5,284,262 | A | 2/1994 | O'Nan | |
| 5,725,291 | A * | 3/1998 | Michels | 206/531 |
| 5,938,086 | A * | 8/1999 | Gross | 222/494 |
| 6,059,132 | A | 5/2000 | Benjamin | |
| 7,107,803 | B1 | 7/2006 | Swanson | |
| 7,252,204 | B1 | 8/2007 | Small | |
| 7,600,648 | B2 | 10/2009 | Hammer | |
| 7,781,422 | B2 | 3/2010 | Tonaltzin | |
| 7,699,414 | B1 * | 4/2010 | Shevrin | A47B 88/00 312/291 |
| 7,866,505 | B2 | 1/2011 | Perlman et al. | |
| 8,020,415 | B2 | 9/2011 | Corbin et al. | |
| 8,201,705 | B2 | 6/2012 | Williamson | |
| 8,517,193 | B1 | 8/2013 | Small | |
| 8,944,263 | B1 | 2/2015 | Small | |
| 2005/0288082 | A1 * | 12/2005 | de la Huerga | A63F 9/0811 463/9 |
| 2013/0062303 | A1 * | 3/2013 | Serell | 215/206 |

* cited by examiner

*Primary Examiner* — Anthony D Stashick
*Assistant Examiner* — James M Van Buskirk

(57) ABSTRACT

A combination locking puzzle gift box consisting of a drawer, a cover, and a plurality of dials. When an unlocking code word is positioned beneath a marker on the cover, the drawer maybe be freely inserted or withdrawn from the cover assembly. In a locked state, the unlocking code is rotated away from beneath the marker and the drawer is locked in place and may not be withdrawn from the cover, thereby securing an item held within.

5 Claims, 7 Drawing Sheets

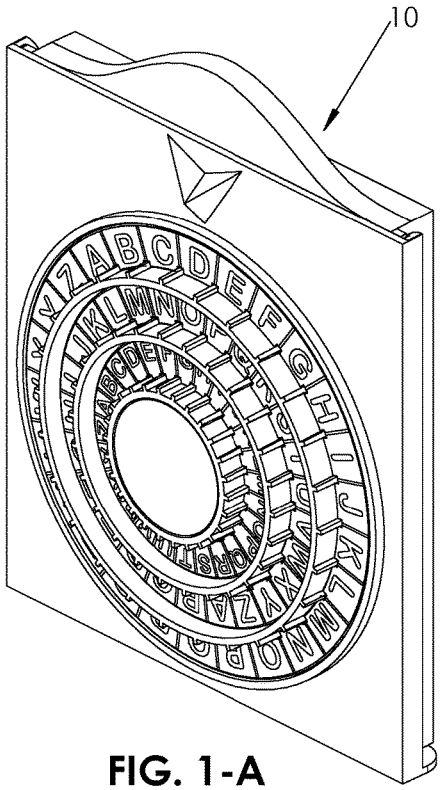
FIG. 1-A
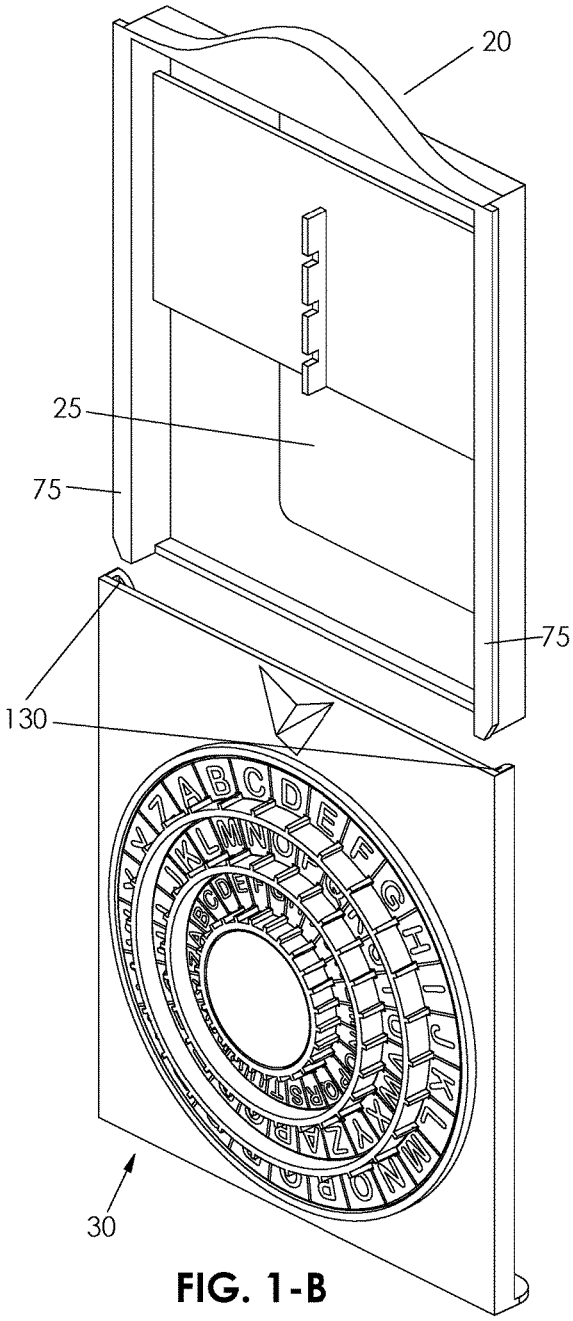
FIG. 1-B

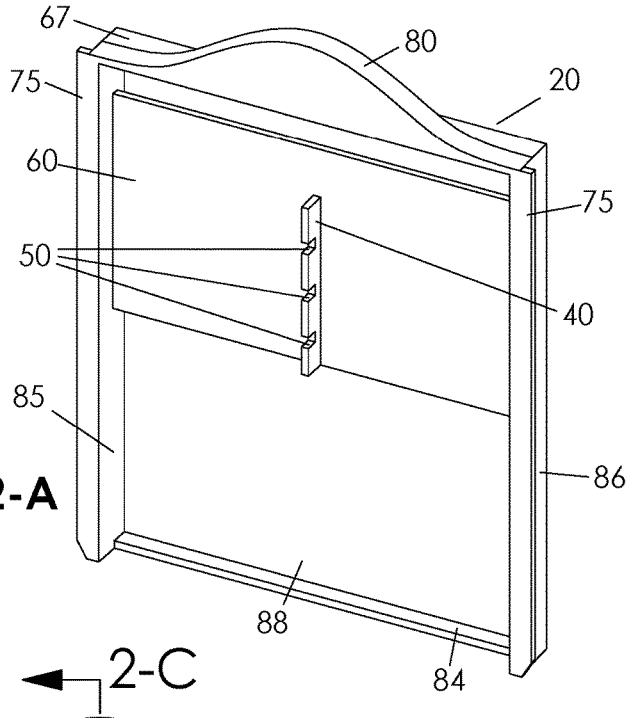
FIG. 2-A
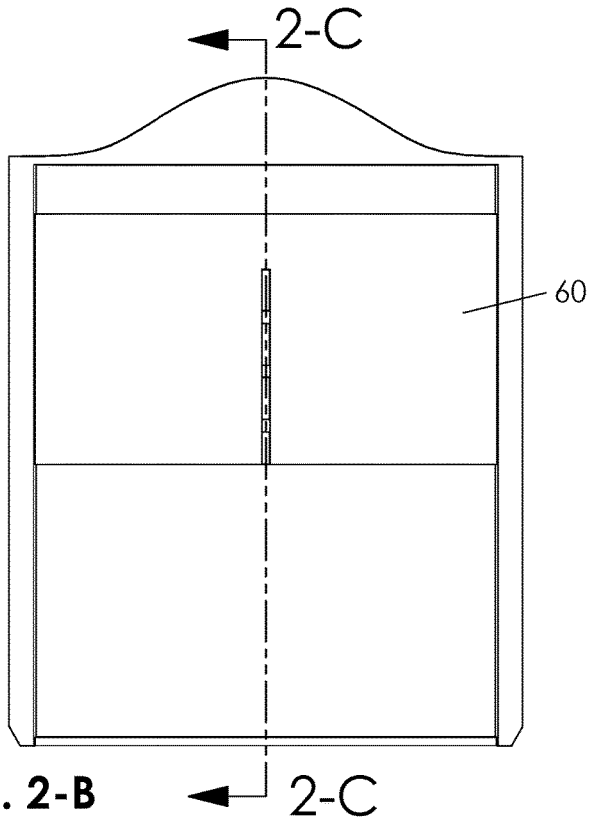
FIG. 2-B
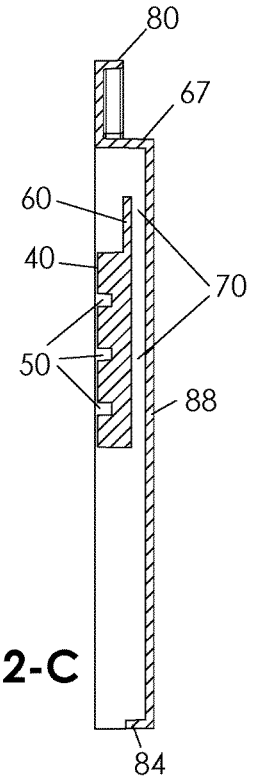
FIG. 2-C

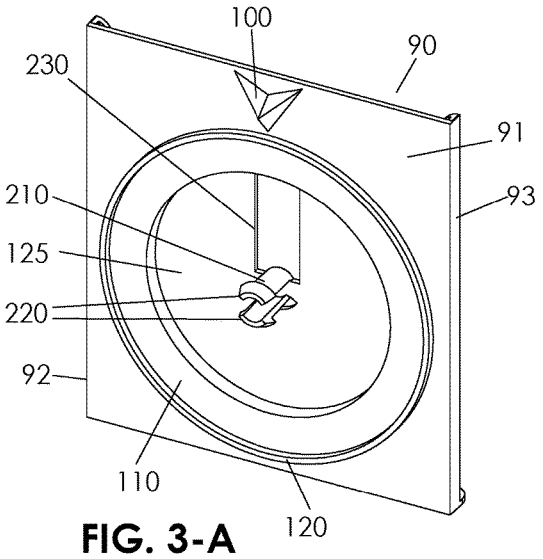
FIG. 3-A
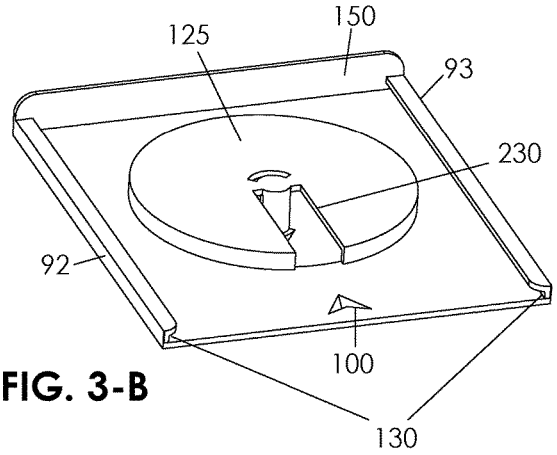
FIG. 3-B
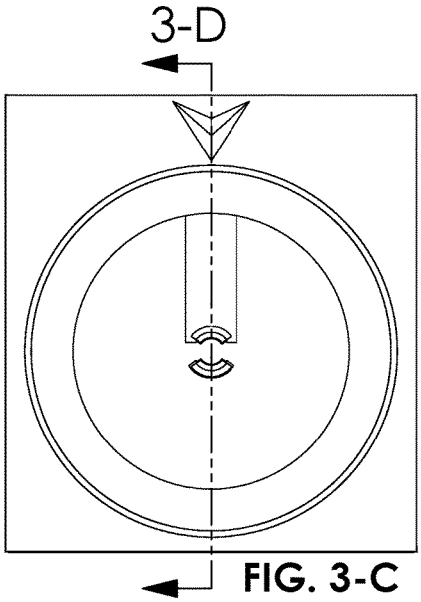
FIG. 3-C
FIG. 3-D
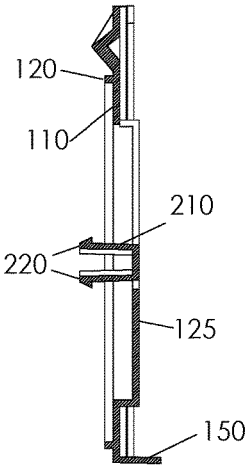
FIG. 3-E
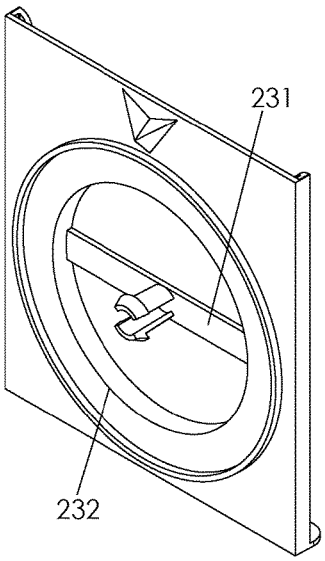

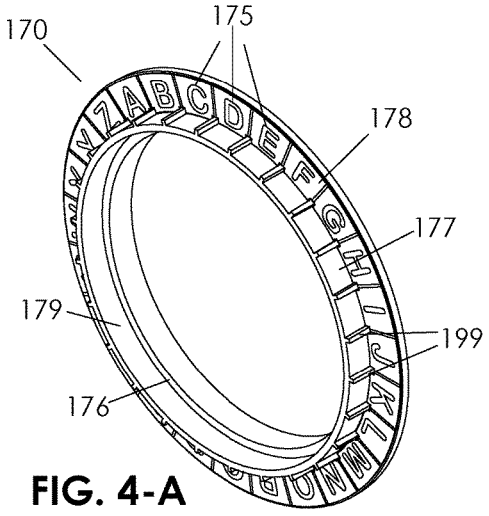
FIG. 4-A
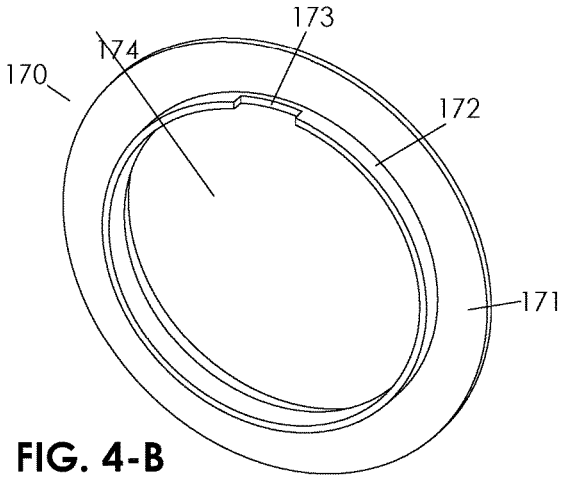
FIG. 4-B
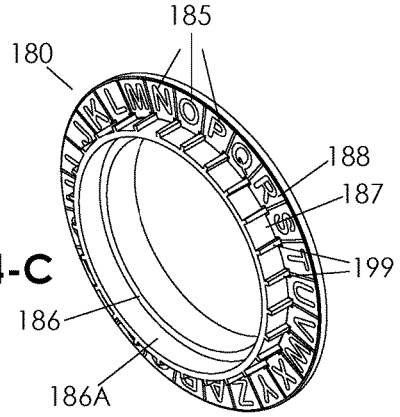
FIG. 4-C
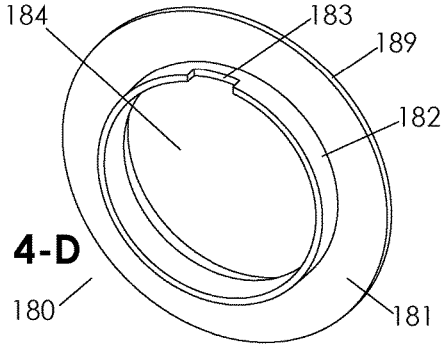
FIG. 4-D
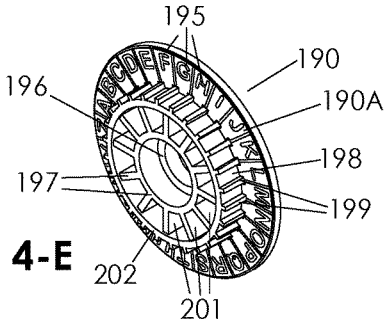
FIG. 4-E
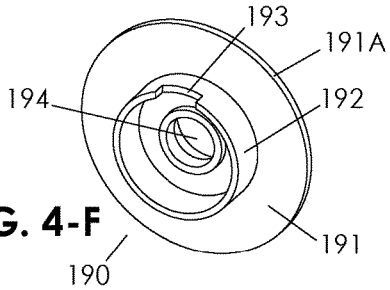
FIG. 4-F

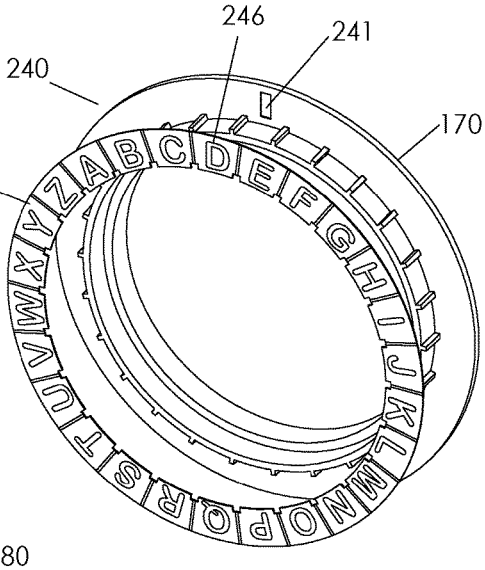
FIG. 5-A
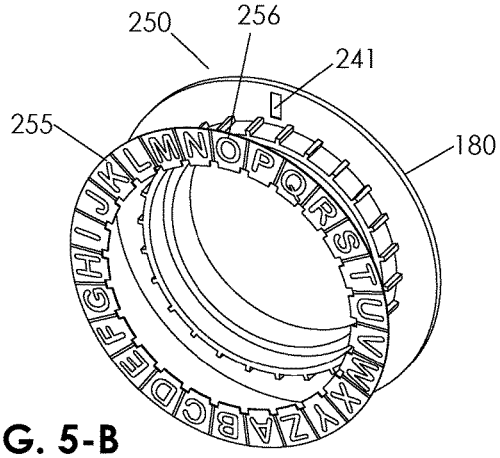
FIG. 5-B
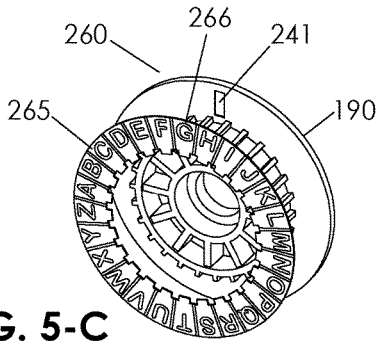
FIG. 5-C

FIG. 6-A
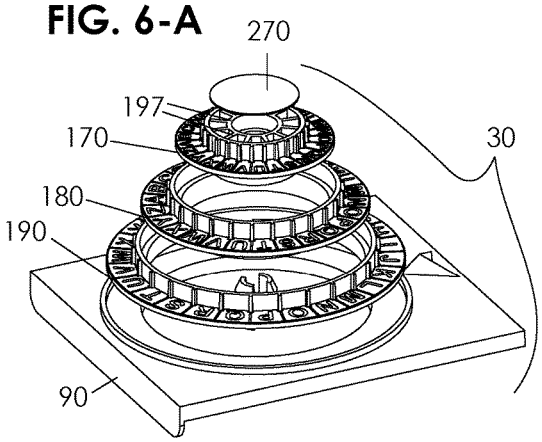
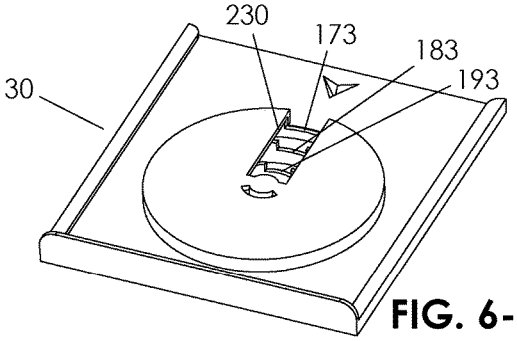
FIG. 6-B
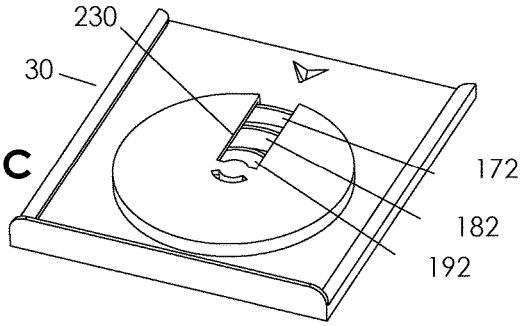
FIG. 6-C
FIG. 6-D
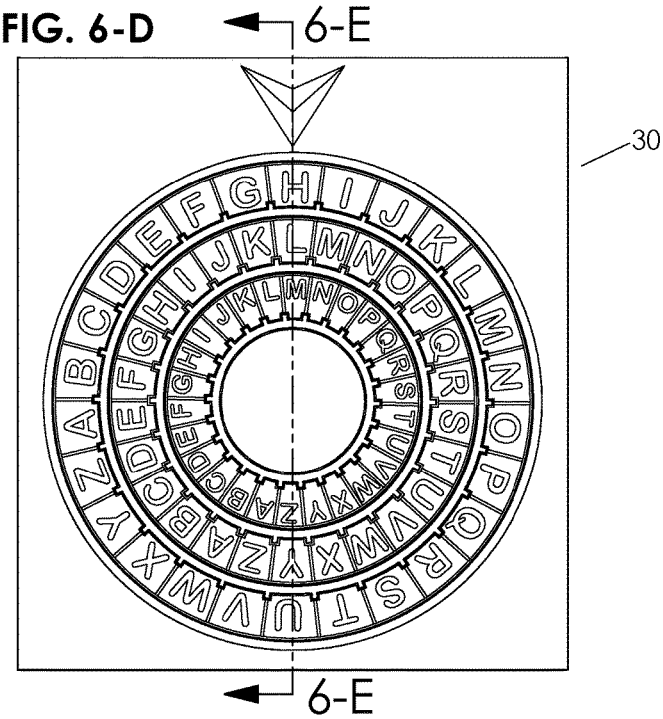
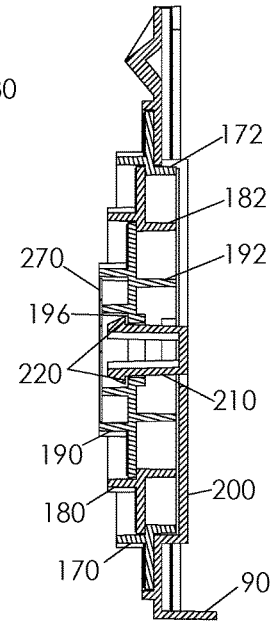
FIG. 6-E FIG. 7-A
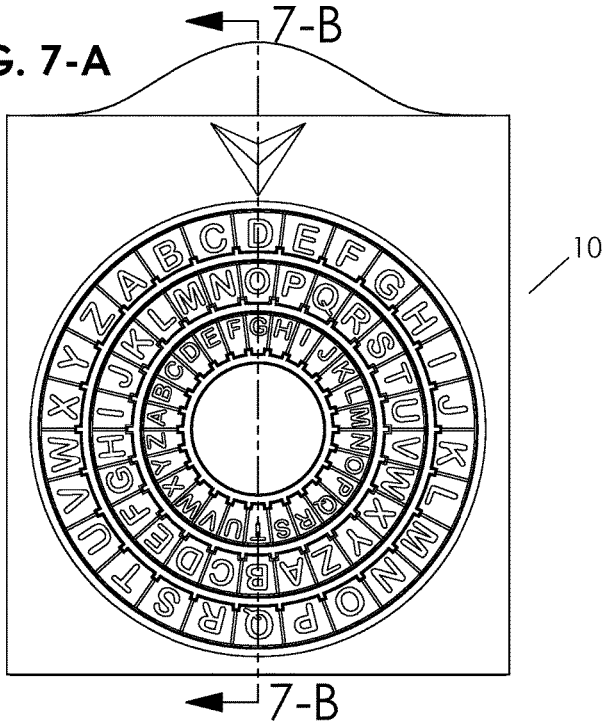
FIG. 7-B
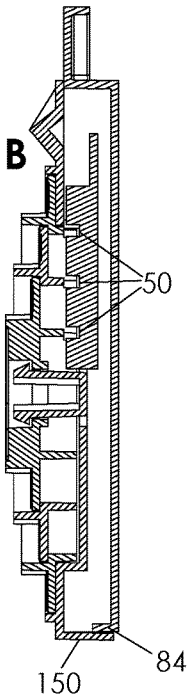
FIG. 7-C
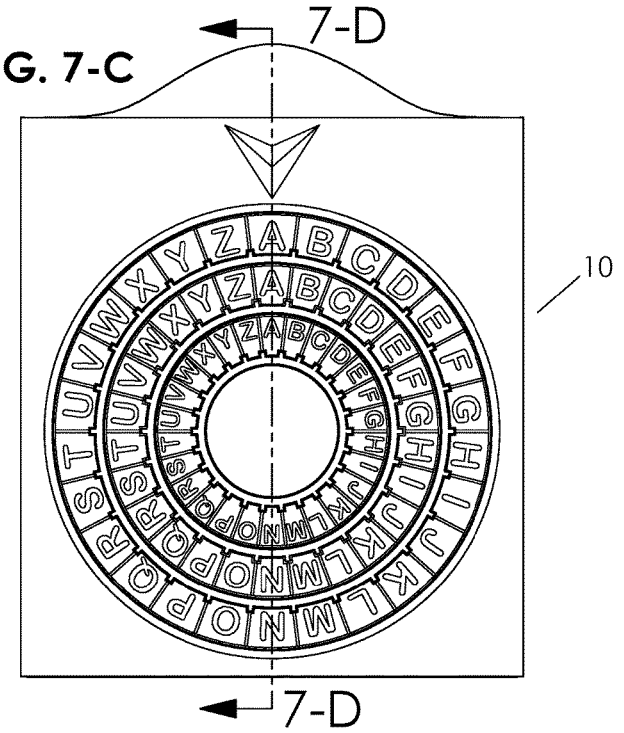
FIG. 7-D
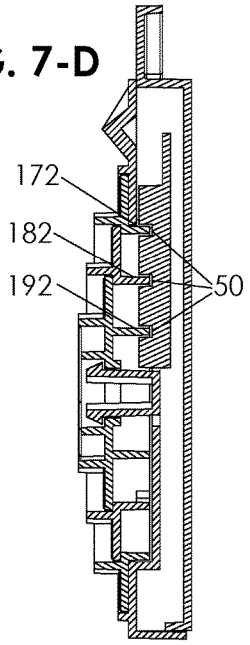

COMBINATION LOCKING PUZZLE GIFT BOX

CROSS-REFERENCE TO RELATED APPLICATIONS

None

FEDERALLY SPONSORED RESEARCH

Not Applicable

SEQUENCE LISTING

Not Applicable

BACKGROUND OF THE INVENTION

Field of Invention

This invention relates to a combination locking puzzle gift box for use with gift cards, cash, and other small items.

Prior Art

The present inventor received a U.S. Pat. No. 8,517,193 in 2013 on a combination locking bottle holder for use with wine bottles or other gifts that can be enclosed within a bottle. The device uses tumblers with indicia that, when aligned to a preset five letter code word, allows the locking mechanism to be opened and the entire bottle or gift to be withdrawn. The product is intended to be a novelty puzzle and game item. After market research, it has been found desirable to have a smaller sized novelty product that can act as a combination locking puzzle gift box for use with smaller items such as gift cards, cash, coins, notes, etc. The solution for this application has required inventing an entirely new locking mechanism to work within a thin compact enclosure assembly. This new invention can be produced in various materials and can be scaled in size for use as a lock box for other commercial applications that require securing larger sized items. In its current application, as a retail puzzle/game product, it can be manufactured with a minimum number of parts, cost, and required assembly.

There are a number of inventions and products on the market related to combination lock boxes. "Prescription Drug Lock Box" U.S. Pat. No. 8,944,263 and "Combination Locking Storage Container" U.S. Pat. No. 8,939,301 both to Small (author of this application) show combination lock boxes with primary use for securing medications. "Locking Pill Bottle U.S. Pat. No. 8,020,415 to Corbin & Warner show a receptacle with a combination locking cap.

Other locking devices such as "Locking Container" U.S. Design Pat. No. D747606 to Serell again show a hinged locking container.

OBJECTS AND ADVANTAGES

It is the object of the present invention to provide a combination locking puzzle gift box for use in giving a present of money, gift cards, or other small items in a novel way having the following advantages which are:

(a) to provide a new interactive game for exchanging gifts by means of solving clues to find an unlocking code word that can be used to open a puzzle box;

(b) to create a novelty product that is simple to manufacture at high volume production levels;

(c) to create a gift puzzle that requires the fewest number of unique parts and which uses a minimum amount of materials (d) to provide a combination locking puzzle that permits easy setup of a personalized unlocking code word;

Still further objects and advantages will become apparent from a consideration of the ensuing description and drawings.

SUMMARY

The present invention provides a combination locking puzzle gift box that can have different embodiments, each with its own advantages depending upon end use application. For promotional marketing uses, it may be desirable to produce large volumes of the product that are all set to an identical unlocking code. Alternatively, it may be preferable to allow end users to set up their own personalized unlocking codes when exchanging gifts. Although materials could vary for various applications, the preferred manufacturing method for producing the components is plastic injection molding. The invention is designed with minimal use of parts and is currently shows use of three dials for the combination (three letter code word), however it could easily be adapted for use with greater or less number of dials.

The invention consists of a drawer, a cover, and plurality of dials. The drawer has a locking rib with gaps or notches along its length. The cover assembly has three concentric dials nested inside of each other and assembled to the cover. Each dial has a cylindrical locking wall beneath it that projects beneath the cover. With the drawer inserted, the locking walls intersect, rotate, and pass through gaps provided in the drawer's locking rib. Each locking cylindrical wall has one break in it. The breaks are angularly aligned with unlocking code indicia on the front of the dials. When the unlocking code is positioned under a marker on the cover, the breaks coincide and are centered to locking rib thus allowing the drawer to be freely inserted or withdrawn from the cover assembly. With the drawer inserted, and cover assembly in a locked state, where one or more dials having the code indicia not aligned with the marker, the full portion of locking cylindrical walls intersect through the gaps in the locking rib and prevent the drawer from being withdrawn.

BRIEF DESCRIPTION OF THE DRAWINGS

FIG. 1-A shows a front oblique view of the combination locking puzzle gift box.

FIG. 1-B shows a front oblique view of the cover and dial sub-assembly with drawer withdrawn.

FIG. 2-A is a front oblique view of the drawer.

FIG. 2-B is a front view of the drawer.

FIG. 2-C is a section view of the drawer.

FIG. 3-A is a front oblique view of the cover.

FIG. 3-B is a rear oblique view of the cover.

FIG. 3-C is a front view of the cover.

FIG. 3-D is a section view of the cover.

FIG. 3-E is an oblique view of an alternative cover embodiment.

FIG. 4-A is a front oblique view of the outer dial.

FIG. 4-B is a rear oblique view of the outer dial.

FIG. 4-C is a front oblique view of the middle dial.

FIG. 4-D is a rear oblique view of the middle dial.

FIG. 4-E is a front oblique view of the inner dial.

FIG. 4-F is a rear oblique view of the inner dial.

FIGS. 5-A, 5-B, & 5-C shows indicia applied as adhesive backed labels.

FIG. 6-A is an exploded oblique view of cover and dial sub-assembly.

FIG. 6-B is a rear oblique view of the cover and dial sub-assembly with dials in an unlocked condition.

FIG. 6-C is a rear oblique view of the cover and dial sub-assembly with dials in locked condition.

FIG. 6-D is a front view of the cover and dial sub-assembly in a locked condition.

FIG. 6-E is a section view of the cover and dial sub-assembly, dials in a locked condition.

FIG. 7-A is a front view of the combination locking puzzle gift box in an unlocked condition FIG. 7-B is a section view of the combination locking puzzle gift box in an unlocked condition FIG. 7-C is a front view of the combination locking puzzle gift box in a locked condition FIG. 7-D is a section view of the combination locking puzzle gift box in a locked condition

| DRAWINGS - REFERENCE NUMERALS | |
|---|---|
| 10 | combination locking puzzle gift box |
| 20 | drawer |
| 25 | gift card |
| 30 | cover and dial sub-assembly |
| 40 | locking rib of drawer |
| 50 | gaps in locking, rib of drawer |
| 60 | suspended planar wall of drawer |
| 67 | upper wall of drawer |
| 70 | space between drawer's front planar wall and suspended wall |
| 75 | side flanges of drawer |
| 80 | handle of drawer |
| 84 | lower wall of drawer |
| 85 | left wall of drawer |
| 86 | right wall of drawer |
| 88 | front planar wall of drawer |
| 90 | cover |
| 91 | front planar wall of cover |
| 92 | left side wall of cover |
| 93 | right side wall of cover |
| 100 | marker |
| 110 | cover surface supporting outer dial |
| 120 | circular rim of cover |
| 125 | recessed cylindrical pocket of cover |
| 130 | undercut slots of the cover |
| 150 | lower side Wall of cover |
| 170 | outer dial |
| 171 | mating, surface of outer dial to cover |
| 172 | cylindrical locking wall of outer dial |
| 173 | break in cylindrical locking wall of outer dial |
| 174 | center opening of outer dial |
| 175 | integrally formed indicia of outer dial |
| 176 | step on cylindrical walls of outer dial |
| 177 | cylindrical hub wall of outer dial |
| 178 | front wall of outer dial |
| 179 | inside diameter of bub on outer dial |
| 180 | middle dial |
| 181 | mating surface of middle dial to outer dial step |
| 182 | cylindrical locking wall of middle dial |
| 183 | break in cylindrical locking wall of middle dial |
| 184 | center opening of middle dial |
| 185 | integrally formed indicia of middle dial |
| 186 | step on cylindrical walls of middle dial |

-continued

| DRAWINGS - REFERENCE NUMERALS | |
|---|---|
| 186A | inside diameter of hub on middle dial |
| 187 | cylindrical hub wall of middle dial |
| 188 | front wall of middle dial |
| 189 | outside diameter of middle dial |
| 190 | inner dial |
| 190A | front wall of inner dial |
| 191 | mating surface of inner dial to middle dial step |
| 191A | outside diameter of inner dial |
| 192 | cylindrical locking wall of inner dial |
| 193 | break in cylindrical locking wall of inner dial |
| 194 | center opening of inner dial |
| 195 | integrally formed indicia of inner dial |
| 196 | seat of inner dial |
| 197 | recessed front facing surface on inner dial |
| 198 | cylindrical hub wall of inner dial |
| 199 | tactile ribs |
| 201 | radial array ribs of inner dial |
| 202 | front facing surface of inner dial hub wall |
| 210 | flexible stem |
| 220 | barbed capture features |
| 230 | cover clearance slot for locking rib |
| 231 | recessed planar wall portion, alternate cover embodiment |
| 232 | circular opening, alternate cover embodiment |
| 240 | embodiment of outer dial for use with adhesive backed indicia label |
| 241 | debossed marker features on dials |
| 245 | adhesive hacked outer label with indicia used with outer dial |
| 246 | example of letter "D" indicia chosen for first letter of unlocking code on outer label |
| 250 | embodiment of middle dial for use with adhesive backed indicia label |
| 255 | adhesive backed middle label with indicia used with middle dial |
| 256 | example of letter "O" indicia chosen for middle letter of unlocking code on middle label |
| 260 | embodiment of inner dial for use with adhesive backed indicia label |
| 265 | adhesive backed inner label with indicia used with inner dial |
| 266 | example a letter "G" indleia chosen for last letter of unlocking code on inner label |
| 270 | adhesive backed center label |

DETAILED DESCRIPTIONS

The following descriptions and drawings illustrate various embodiments. There is no single preferred embodiment. Each has advantages depending upon its intended end use and application. Each embodiment may require different materials or need be sized to provide greater mechanical strength or rigidity. The drawings and descriptions below do not imply or suggest any specific dimensions, wall thickness, or materials. Likewise exact values for fits, allowances, tolerances, etc. are not specified.

DETAILED DESCRIPTION—EMBODIMENT USING INTEGRALLY FORMED INDICIA FIGS. 1-A THROUGH 4-H

A first embodiment of a combination locking puzzle gift box using dials with integrally formed indicia is illustrated in FIGS. 1-A through 4-H. FIGS. 1-A & 1-B show the combination locking puzzle gift box 10 consisting of a drawer 20, and a cover and dial sub-assembly 30. The drawer has spacing suitable for insertion of a gift card 25 or other similar small thin items such as cash, coins, or paper notes. Side flanges of drawer 75 fit into and can be accepted by the undercut slots of the cover 130, where the drawer may slide into and be withdrawn from the cover assembly. FIG. 2-A shows a front oblique view of the drawer 20. The drawer is defined by a front planar wall 88, left wall 85, right wall 86, upper wall 67, and lower wall 84. The drawer's left and right walls have side flanges 75 integrally formed and extending perpendicularly. Although not essential to the mechanical function, a handle feature of drawer 80 may be integrally formed above the drawer's upper wall to assist in its withdrawal or insertion. Spanning between the left and right side walls of the drawer is a suspended planar wall 60. Projecting perpendicularly from the suspended wall and centered to the width of the drawer is a locking rib 40. The locking rib has a plurality of gaps 50 cut though its length. FIG. 2-B shows a front view of the drawer and FIG. 2-C is a cross-sectional view of drawer centered to its width and showing resulting space 70, of suitable size to accept a gift card or similar, between the front planar wall 88 and suspended planar wall 60.

FIGS. 3-A through 3-D show details of the cover 90. FIG. 3-A shows a front oblique view of the cover. The cover is defined by a front planar wall 91, left side wall 92, right side wall 93, lower wall 150, and a recessed cylindrical pocket 125. A slot 230 that provides clearance with the drawer's locking rib is positioned above the pocket's center and extends through to the pocket's outside diameter wall, and is aligned to a 12 o'clock position. Protruding from the center of the pocket's front facing wall is a flexible stem 210 with barbed capture features 220 formed at the top of the stem. The flexible stem is a cored cylinder that has a split or gap in its center, whereby the material removed allows the sides of the cylinder to flex and collapse inwardly. The flexible stem and barb features together comprise a typical snap fit retaining feature which is used to secure the dials—to be discussed. Formed into the front wall of the cover at a 12 o'clock position above the opening is a marker 100. Formed perpendicularly on the cover's front wall and coaxial to the pocket is a short circular rim 120. The flat annular surface 110 on the cover's front wall, bounded between the circular rim and the pocket edge, represents a mating surface for support of the outer dial—to be discussed shortly. FIG. 3-B shows a rear oblique view of the cover. Left and right side walls of the cover have undercut slots 130 which are sized to accept the drawer flanges and allow the drawer to linearly slide in and out of the cover. FIG. 3-C shows a front view of the cover and FIG. 3-D shows a cross-sectional view of the cover centered at its width. FIG. 3-E shows alternate embodiment of the cover, where instead of a pocket, center area is mostly open and has a recessed planar wall portion 231 bridging across the circular opening 232, where this wall portion width supports the snap fit retaining feature.

FIG. 4-A though 4-F show views of three different sized dials used with the cover assembly—outer dial 170, middle dial 180, and inner dial 190. FIGS. 4-A, 4-C, and 4-E are front facing oblique views. FIGS. 4-B, 4-D, and 4-F are rear facing oblique views. The dials' front walls 178, 188, and 190A are flat, annularly formed with a nominal thin walled rectangular cross-section, each having a center opening 174, 184, and 194. Dials have rear facing planar surfaces 171, 181, and 191. Extending perpendicularly from the rear facing surfaces, and adjacent to the perimeter of the openings, are cylindrical locking walls 172, 182, and 192. Breaks in cylindrical locking walls 173, 183, and 193 are aligned to a 12 o'clock position on the dials. The dials' front facing surfaces have a plurality of integrally formed indicia 175, 185, and 195 that are positioned in a radial arrays about the central axes of the dials. For each dial, a single indicia aligned to a 12 o'clock position represents one letter of a three letter unlocking code word. Note that the unlocking code indicia are angularly aligned with respect to the breaks in the locking walls. For the dials illustrated in the figures, the unlocking code from outer dial to inner dial, spells out the three letter word "D-O-G." The unlocking code indicia may be integrally formed by any number of means which may include, but are not limited to, embossing, debossing, pad printing, laser etching, etc. Extending perpendicularly from dials' front surfaces are cylindrical hub walls 177, 187, 198. Although not essential to function, short tactile ribs 199 are formed in a radial arrays on the outer diameters of the hub walls. The hub walls and tactile ribs allow for individually rotating or turning the dials with finger tips. On the inner dial, a radial array of ribs 201 span between the locking cylinder wall and the hub wall. The front facing surface represented by the top of the rib array and locking cylinder wall 197 is slightly recessed with respect to the front facing surface of the hub wall 202. The recessed surface allows placement of an adhesive backed center label—which will be discussed shortly. Steps in outer and middle dials' cylindrical walls 176 and 186 are formed by offset diameters of hub walls in relationship to locking walls. Seat of inner dial 196 is shown formed on the cylindrical locking wall. The outer dial is sized such that it can be assembled on to the cover with the mating surface 171 seating against the previously described flat annular surface on the cover. The cover's circular rim and recessed pocket are closely sized to accept and coaxially align the outer dial such that the outer dial may freely rotate within the cover's front wall. Step 176 of the outer dial provides a seat for placement of the middle dial's rear facing surface 181. The inside diameter of hub on outer dial 179 has a close fit with outside diameter of the middle dial 189, such that the middle dial may rotate freely when nested into the outer dial. Step 186 of the middle dial provides a seat for placement of the inner dial's rear facing surface 191. The inside diameter of hub on middle dial 186A has a close fit with outside diameter of the inner dial 191A, such that the inner dial may rotate freely when nested into the middle dial. Sized in this manner the dials may be stacked and nested within each other and are free to rotate independently of each other when assembled to the cover. The function of the previously described cover snap fit retaining feature is to capture and retain the three dials thus producing the cover and dial sub-assembly. The snap fit retaining feature is inserted through the inner dial's center opening and the barb features mate and snap into the seat of inner dial 196. Note that other mechanical attachment means are possible and could be used to secure the dials to the cover such as, but not limited to, heat staking, screws, retaining rings, clips, pins, or other fasteners.

Embodiment Using Adhesive Backed Labels with Indicia

FIGS. 5-A though 5-C show alternative embodiments for the dials which allow end users to program personalized unlocking code indicia. Outer dial 170, middle dial 180, and inner dial 190 all have a debossed marker feature 241 on front wall at the 12 o'clock position. The markers are angularly aligned with and positioned in front of the breaks in cylindrical locking walls. Outer, middle, and inner adhesive backed labels with indicia 245, 255, and 265 may be angularly indexed and applied at various positions to allow the use of any indicia as part of a code word. Chosen code letters of a three letter word are positioned in front of the debossed mark locations on the dials. Example in FIG. 5-A shows use of letter "D" indicia chosen for first letter of unlocking code on outer label 245 and indexed with debossed marker feature of outer dial. Example in FIG. 5-B shows use of letter "O" indicia chosen for middle letter of unlocking code on middle label 255 and indexed with debossed marker feature of middle dial. Example in FIG. 5-C shows use of letter "G" indicia chosen for last letter of unlocking code on inner label 265 and indexed with debossed marker feature of inner dial. The example shown is set to the unlocking code word of "D-O-G."

FIG. 6-A shows an exploded view of the cover and dial sub-assembly 30. Although not essential to mechanical function, an adhesive backed center label 270 may be added for aesthetic purposes, to conceal the open cored portions of the inner dial as well as the cover's snap fit retaining feature. The center label can be seated into the recessed front facing surface 197 on the inner dial. FIG. 6-B shows a rear oblique view of the cover and dial sub-assembly in an unlocked condition. In the unlocked condition, all three letter of the unlocking code word are angularly aligned with and directly beneath the marker on cover. Likewise, in this unlocked condition, as can be seen in FIG. 6-B, all breaks in cylindrical locking wall 173, 183, and 193 of dials are at a 12 o'clock position and centered with respect to the marker creating an open channel in the assembly. The open channel provides clearance for the locking rib of the drawer to pass through, when the drawer is either inserted into or withdrawn from the cover assembly. FIG. 6-C shows a rear oblique view of the cover and dial sub-assembly in a locked condition. The cover assembly in a locked condition is defined by one or more dials rotated such that the unlocking code indicia and word are unaligned with the cover marker. Likewise, in the locked condition, the breaks in dials' cylindrical locking walls are unaligned with respect to the marker. As can be seen in FIG. 6-C, with the cover and dial subassembly in locked condition, full portions of the dial's cylindrical locking walls intersect the area where the drawers locking rib passes through. FIG. 6-D shows a front view of the cover and dial sub-assembly in a locked condition where a code word is not aligned beneath the cover marker.

FIG. 6-E shows a cross-sectional view taken from the center width of the cover and dial sub-assembly in a locked condition. The nesting and coaxial assembly relationships between the dials and cover can be seen as well as the function of snap fit retaining feature used to secure the dials. Note that the previously described short rim of the cover is not essential to the mechanical function, because the outer dial can be axially constrained and centered by either the pocket's inside diameter, or in the case of the alternate cover embodiment, the central circular opening.

FIG. 7-A is a front view of the combination locking puzzle gift box. The cover and dial sub-assembly is shown in an unlocked condition with the drawer fully inserted. The unlocking indicia and code word of "D-O-G" are shown aligned beneath the marker on the cover. FIG. 7-B shows a cross-sectional view of the assembly in an unlocked condition. Depth of the drawer inserted into the cover assembly is controlled by lower wall of the drawer 84 stopping against the lower wall of the cover 150. This view shows that in the unlocked condition, the locking cylindrical walls of the dials do not intersect the gaps in locking rib 50 on the drawer and the drawer may freely be inserted or withdrawn from the cover assembly. FIG. 7-C is a front view of the combination locking puzzle gift box in a locked condition. The unlocking indicia and code word are not aligned beneath the marker on the cover. FIG. 7-D shows a cross-sectional view of the assembly in a locked condition. This view shows that in the locked condition, the locking cylindrical walls of the dials intersect the gaps of locking ribs on the drawer and prevent the drawer from either being inserted into or withdrawn from the cover assembly, thus a gift card, cash, or similar item may be secured within.

CONCLUSION, RAMIFICATIONS, AND SCOPE

Accordingly, the reader will see that combination locking puzzle gift box of this invention can secure small items such as gift cards, cash, coins, paper notes, etc. and can be used as a novel way to give a present. In its simplest embodiment, its mechanical function relies upon just three basic elements: a drawer, cover, and a set of dials. In applications where end users may wish to set and reset personalized unlocking code words, an embodiment that uses adhesive backed labels as means for applying indicia to dials may be of advantage. Although the description above contains many specifications, these should not be construed as limiting the scope of the invention but as merely providing illustrations of some of the various embodiments of this invention. Different materials, or combinations thereof, could be used in manufacture of the embodiments. Such materials could include but are not limited to metals, plastics, woods, or laminates. Manufacturing processes used for producing the components could include plastic injection molding, die casting, investment casting, forging, machining, among others. The design could be altered to utilize more or less than three dials and sized appropriately. The means for retaining the dials to the cover could be accomplished by other methods including but not limited to heat staking, ultrasonic welding, or uses of mechanical components. Other language alphabets, colors, symbols, etc. could be used for indicia, and the number of indexing positions on each dial could be greater or less than a twenty-six letter alphabet. In addition, the invention is not limited to just gift cards, cash or thin items. The scale of the box could easily be enlarged and have greater volume to accommodate larger items and be useful in other application aside from gift giving. Thus the scope of the invention should be determined by the appended claims and their legal equivalents, rather than the examples given.

What is claimed is:

1. A combination locking puzzle gift box comprising: a drawer; a cover; and a plurality of dials;

said drawer being defined by a front wall, a left wall, a right wall, an upper wall, and a lower wall, said left and right walls each having a side flange outwardly formed and extending perpendicularly from the left and right wall's exterior edges, interior surfaces of the left and right walls having a suspended wall therebetween being positioned above said front wall, wherein a resulting space between said suspended wall and said front wall is sized for acceptance of an item which is held within said drawer, said suspended wall further having a locking rib formed and projecting perpendicularly from its front facing surface, said locking rib having a plurality of gaps or notches cut into its length and;

said cover being defined by a front planar wall, a left side wall, a right side wall, and a lower wall, said left and right side walls of the cover having undercut slots, whereby said undercut slots are sized to accept the drawer flanges, wherein said drawer slides linearly into and out of said cover, wherein a depth of said drawer at full insertion into said cover is determined by said lower wall of said drawer coming into contact against said lower side wall of said cover, and the cover's front wall further having an opening, said cover further having a recessed wall formed adjacent to and behind the cover opening, wherein when said drawer is fully inserted into said cover, a clearance exists between the cover's recessed wall and the drawer's locking rib, said recessed wall further having integral means for securing said plurality of dials to said cover, said cover further having a marker formed into said front planar wall, said marker having alignment with said locking rib of the inserted drawer; and said plurality of dials, wherein each of said plurality of said dials is annularly formed with an opening, each dial being a different diameter with respect to each other, wherein each of said plurality of said dials has a cylindrical locking wall projecting perpendicularly from a rear facing surface of each of said plurality of said dials, wherein each cylindrical locking wall has at least one break or gap along each of said cylindrical locking wall perimeters, wherein the widths of the breaks are greater than a thickness of the drawer's locking rib, and a front facing surface of each of said plurality of said dials having a plurality of indicia positioned in a radial array about a central axis of each of said plurality of said dials, wherein one indicia on each of said plurality of said dials is angularly aligned with and centered to the break in each said cylindrical locking wall and represents one character of an unlocking code, each of said plurality of said dials further having a cylindrical hub wall projecting perpendicularly from a front surface of each of said plurality of said dials and coaxial to each said cylindrical locking wall, wherein the hub walls are used to turn or rotate individual dials, each of said plurality of said dials further having a step formed by offset diameters of the locking wall and a hub wall, wherein said step formed on one of said plurality of said dials provides support to the subsequent dial of smaller diameter, wherein an inside diameter of said hub wall has a close fit to an outside diameter of the subsequent dial of with the smaller diameter, wherein said plurality of said dials has an ability to concentrically nest and stack upon each other, and wherein the cover opening accepts and has a close fit with said cylindrical locking wall of the largest dial, wherein a stack of nested dials are assembled and supported by the front wall of cover, whereby the largest dial is positioned flush against the front wall of said cover and the smallest dial is at a relative position furthest from said cover, wherein said cover secures the dials and cooperates with and attaches to the smallest dial, whereby all of the dials are secured to said cover and wherein the dials' rotational axes are perpendicular with respect to both the longitudinal orientation of the locking rib and direction in which the drawer is inserted or withdrawn from the cover, and wherein the dials' cylindrical locking walls protrude behind the front wall of said cover to a depth which lies in front of the cover's recessed wall, and with said drawer fully inserted into said cover, the dial locking walls are concentrically spaced and positioned to intersect through the corresponding gaps of the drawer's locking rib;

wherein, an unlocked condition is defined when all characters of the unlocking code on said plurality of dials are aligned to the cover marker and the breaks of each cylindrical locking wall are rotated to the top of the locking wall relative to the cover marker and the breaks of the locking walls are aligned with the drawer's locking rib, whereby in said unlocked condition, said drawer may be freely inserted into or withdrawn from said cover, and a locked condition is defined by one or more unlocking code characters misaligned with the cover marker and at least one full portions of the dial cylindrical locking wall intersects the gap of the drawer's locking rib, thereby preventing said drawer from being withdrawn from the cover and thus securing said item held within the drawer.

2. The combination locking puzzle gift box of claim 1 wherein: each of the plurality of dials additionally has a debossed marker feature on its front facing wall, said debossed marker features are aligned with and centered to the breaks of each cylindrical locking wall, and the plurality of indicia may consist of adhesive backed labels with printed indicia, where the included labels may be applied to the front walls facing surfaces of the dials, whereby any indicia on any label may be selected and aligned with said debossed marker during application of the labels to the dials, wherein the selected indicia may be used as characters of said unlocking code.

3. The combination locking puzzle gift box of claim 1 wherein: said upper wall of drawer includes a handle portion.

4. The combination locking puzzle gift box of claim 1 wherein: means for securing said plurality of dials to said cover consists of a snap fit retaining feature formed on said cover, whereby the snap feature fits into the inside diameter of the smallest dial and engages with its formed step thus securing the nested and stacked set of dials to said cover.

5. The combination locking puzzle gift box of claim 4 wherein: an adhesive backed center label is included and applied to the front face of smallest dial, whereby the center label is used aesthetically to conceal said snap fit retaining feature.

* * * * *